US012085066B2

(12) United States Patent
Vincent et al.

(10) Patent No.: US 12,085,066 B2
(45) Date of Patent: Sep. 10, 2024

(54) PULSATILE FLUID PUMP SYSTEM

(71) Applicant: VentriFlo, Inc., Pelham, NH (US)

(72) Inventors: Douglas E. Vincent, Pelham, NH (US); Brian Bailey, Chelmsford, MA (US); Conrad Bzura, Melrose, MA (US); David Butz, Groton, MA (US); David Olney, Chester, NH (US); Eric Smith, Newburyport, MA (US); George Koenig, Nashua, NH (US); James W. Poitras, St. Cloud, FL (US); Jeffrey P. Naber, Mont Vernon, NH (US); Judy Labonté, Hudson, NH (US); Kathleen Vincent, Pelham, NH (US); Lawrence Kuba, Nashua, NH (US); Matthew J. Murphy, Marshfield, MA (US); Patrick Shields, Westford, MA (US); Roger Greeley, Portsmouth, NH (US)

(73) Assignee: VentriFlo, Inc., Pelham, NH (US)

( * ) Notice: Subject to any disclaimer, the term of this patent is extended or adjusted under 35 U.S.C. 154(b) by 0 days.

(21) Appl. No.: 17/183,080

(22) Filed: Feb. 23, 2021

(65) Prior Publication Data

US 2022/0265993 A1 Aug. 25, 2022

(51) Int. Cl.
*F04B 43/04* (2006.01)
*F04B 39/14* (2006.01)
(Continued)

(52) U.S. Cl.
CPC ..... *F04B 43/04* (2013.01); *F04B 39/14* (2013.01); *F04B 53/22* (2013.01);
(Continued)

(58) Field of Classification Search
CPC .... F04B 49/065; F04B 43/0081; F04B 43/04; F04B 45/047; F04B 39/14; F04B 53/22;
(Continued)

(56) References Cited

U.S. PATENT DOCUMENTS 4,403,539 A * 9/1983 Motoki ..... F01B 19/00 417/328
5,056,992 A * 10/1991 Simons ..... F04B 43/021 417/474

(Continued)

FOREIGN PATENT DOCUMENTS

DE 102017215658 A1 3/2017
WO 90/08260 A1 7/1990

OTHER PUBLICATIONS

International Searching Authority—International Search Report, pertaining to International Application No. PCT/US2021/019266, dated Oct. 8, 2021, together with the Written Opinion of the International Searching Authority, 11 pages.

*Primary Examiner* — Bryan M Lettman
(74) *Attorney, Agent, or Firm* — Sunstein LLP

(57) ABSTRACT

A pulsatile fluid pump system includes a pump-valving assembly including a chamber and a diaphragm assembly coupled to the chamber and including a flexible diaphragm. The diaphragm assembly and the pump-valving assembly are configured as an integral pump assembly. The system further includes a linear motor having a magnet and a coil, the magnet moving in relation to the coil, the coil having an electrical input. The system also includes a control housing rigidly coupled to the linear motor and a controller system having an electrical output coupled to the electrical input of the coil, the controller system defining an electrical waveform at the electrical output to cause desired operation of the diaphragm. The integral pump assembly is configured to be removably coupled to the control housing, and the diaphragm assembly of the integral pump assembly is configured to be removably coupled to the linear motor.

18 Claims, 10 Drawing Sheets

(51) Int. Cl.
*F04B 43/00* (2006.01)
*F04B 49/06* (2006.01)
*F04B 53/22* (2006.01)

(52) U.S. Cl.
CPC ..... *F04B 43/0081* (2013.01); *F04B 49/065* (2013.01); *F04B 2203/04* (2013.01)

(58) Field of Classification Search
CPC ... F04B 2203/04; F15B 15/1447; F15B 15/10
USPC ..... 92/99, 98 R, 101
See application file for complete search history.

(56) References Cited

U.S. PATENT DOCUMENTS 5,064,353 A 11/1991 Tsukahara
5,222,523 A * 6/1993 Trimble ..... F16K 11/022 137/863
5,645,407 A * 7/1997 Kralick ..... H02K 33/16 417/383
8,015,912 B2 * 9/2011 Stimpson ..... F04B 53/105 92/99
2001/0008608 A1 * 7/2001 Ohya ..... F04B 39/14 417/413.1
2004/0191098 A1 * 9/2004 Wu ..... F04B 33/005 417/469
2004/0208756 A1 * 10/2004 Adahan ..... F04B 53/22 417/360
2007/0255089 A1 11/2007 Vincent et al.
2009/0157016 A1 * 6/2009 Adahan ..... A61M 1/90 604/290
2010/0308074 A1 * 12/2010 Vanquickenborne ... F04B 53/10 222/1
2011/0318198 A1 * 12/2011 Johnson ..... F04B 43/12 417/300
2012/0051956 A1 * 3/2012 Grip ..... A61M 5/1413 417/413.1
2012/0321485 A1 * 12/2012 Proietti De Marchis ..... F04B 13/00 417/44.1
2014/0161644 A1 * 6/2014 Weatherley ..... F04B 53/22 417/360
2015/0144821 A1 5/2015 Teylor
2017/0191478 A1 * 7/2017 Horning ..... F04B 53/126
2017/0191563 A1 * 7/2017 Horning ..... F04B 17/06
2018/0291882 A1 * 10/2018 Algawi ..... F04B 53/16
2023/0184235 A1 * 6/2023 Theisen ..... F04B 53/147 417/415

* cited by examiner

PULSATILE FLUID PUMP SYSTEM

RELATED APPLICATIONS

The present application is one of four applications being filed on the same day and bearing publication numbers 2022/0265994 and 2022/0265993, and patent numbers 11,236,741 and 11,300,119. Each of these related applications and patents, other than the present application, is hereby incorporated herein by reference in its entirety.

TECHNICAL FIELD

The present invention relates to pulsatile fluid pumps, and more particularly to pulsatile fluid pumps suitable for pumping blood.

BACKGROUND ART

A pulsatile fluid pump is taught in U.S. Pat. No. 7,850,593 ("our prior patent") for an invention of Douglas Vincent and Matthew Murphy, who are co-inventors of the present invention. Our prior patent discloses a pump actuated by a linear motor configured to cause reciprocation of a flexible membrane, serving as a wall of a fluid housing, that is in turn coupled to a pair of ball valves, in a manner as to implement pulsatile fluid flow.

SUMMARY OF THE EMBODIMENTS

In accordance with one embodiment of the invention, a pulsatile fluid pump system includes a pump-valving assembly including a chamber and a set of ports; and a diaphragm assembly coupled to the chamber and including an edge-mounted flexible diaphragm having an inside surface for contacting a fluid in the chamber to be pumped and an outside surface exposed to ambient air. The diaphragm assembly and the pump-valving assembly are configured as an integral pump assembly. The pulsatile fluid pump system further includes a linear motor having a magnet and a coil, the magnet moving in relation to the coil, the coil having an electrical input. The pulsatile fluid pump system also includes a control housing rigidly coupled to the linear motor and a controller system having an electrical output coupled to the electrical input of the coil, the controller system defining an electrical waveform at the electrical output to cause desired operation of the diaphragm. The integral pump assembly is configured to be removably coupled to the control housing, and the diaphragm assembly of the integral pump assembly is configured to be removably coupled to the linear motor.

Alternatively or in addition, the pulsatile fluid pump system further includes a push rod, coupled to the linear motor, and configured for removable attachment to the diaphragm assembly. Also alternatively or in addition, the pulsatile fluid pump system further includes a force sensor coupled between the linear motor and the push rod.

In a related embodiment, the pulsatile fluid pump system further includes a flexible seal surrounding the push rod. Alternatively or in addition, the pulsatile fluid pump system further includes a set of cooling fins thermally coupled to the coil of the linear motor. Also alternatively or in addition, the push rod is slidably attached to the diaphragm assembly.

Alternatively or in addition, the controller system includes a microprocessor, and the controller system is configured to execute a waveform program defining an electrical waveform at the electrical output to cause desired operation of the diaphragm.

In a further related embodiment, the integral pump assembly has a peripheral flange, and the control housing has a channel configured to removably receive the peripheral flange if the diaphragm assembly of the integral pump assembly is removably coupled to the linear motor. Alternatively or in addition, at least one of the peripheral flange and the channel has a set of compliant members to physically bias the peripheral flange in the control housing. Also alternatively or in addition, each compliant member includes a spring, Further alternatively or in addition, the pulsatile fluid pump system further includes a latch configured to constrain the integral pump assembly in the channel. Alternatively or in addition, the set of compliant members is included in a set of ball detents.

In a related embodiment, the diaphragm assembly further includes a coupler configured to reciprocate with the diaphragm, and the integral pump assembly includes a pump housing having a neck configured to maintain axial and rotational alignment of the coupler.

In accordance with an alternative embodiment of the invention, an integral pump assembly for a pulsatile fluid pump system includes a pump-valving assembly including a chamber and a set of ports; and a diaphragm assembly coupled to the chamber and including an edge-mount flexible diaphragm having an inside surface for contacting a fluid in the chamber to be pumped and an outside surface exposed to ambient air. The pump-valving assembly and diaphragm assembly are disposed in an integral pump assembly housing configured to be removably coupled to a control housing for the pulsatile pump system, the control housing including a linear motor having a magnet and a coil, the magnet moving in relation to the coil, the coil having an electrical input, the control housing rigidly coupled to the linear motor. The electrical input of the coil is coupled to the electrical output of a controller system defining an electrical waveform at the electrical output to cause desired operation of the diaphragm. The diaphragm assembly of the integral pump assembly is similarly configured to be removably coupled to the linear motor.

Alternatively or in addition, the integral pump assembly housing includes a peripheral flange, and the control housing has a channel configured to removably receive the peripheral flange if the diaphragm assembly of the integral pump assembly is removably coupled to the linear motor. Also alternatively or in addition, the peripheral flange has a set of compliant members to physically bias the peripheral flange in the control housing.

In a related embodiment, each compliant member includes a spring. Alternatively or in addition, the set of compliant members is included in a set of ball detents.

In accordance with yet another embodiment of the invention, a control housing is provided for removably receiving and being removably coupled to an integral pump assembly for a pulsatile fluid pump system. The integral pump assembly includes (i) a pump-valving assembly including a chamber and a set of ports; and (ii) a diaphragm assembly coupled to the chamber and including an edge-mount flexible diaphragm having an inside surface for contacting a fluid in the chamber to be pumped and an outside surface exposed to ambient air. The pump-valving assembly and diaphragm assembly are disposed in an integral pump assembly housing. The control housing includes a chassis; a linear motor, rigidly coupled to the chassis, and having a magnet and a coil, the magnet moving in relation to the coil, the coil having an electrical input; and a controller system having an electrical output coupled to the electrical input of the coil, the controller system defining an electrical waveform at the electrical output to cause desired operation of the diaphragm. The control housing is configured to be removably coupled to the integral pump assembly, and the linear motor is configured to be removably coupled to the diaphragm assembly of the integral pump assembly.

Alternatively or in addition, the integral pump assembly has a peripheral flange, and the control housing further has a channel configured to removably receive the peripheral flange if the diaphragm assembly of the integral pump assembly is removably coupled to the linear motor.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Figure 1:
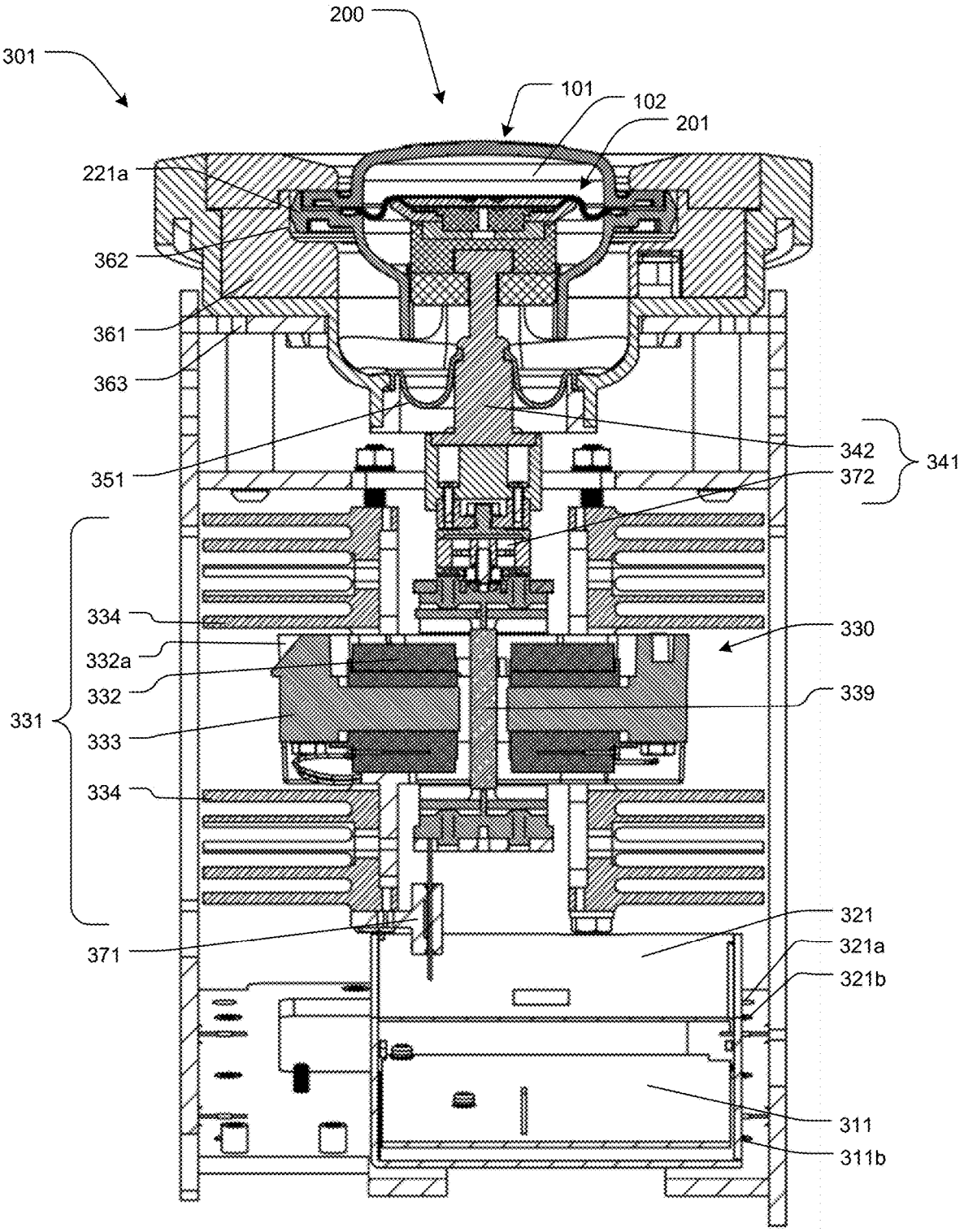
FIG. 1 is a vertical section of the pulsatile fluid pump system 301 showing the controller system 311, power amplifier 321, linear motor 330 (coil 332, cooling fins 334, and magnet 339), push rod assembly 341, flexible seal 351, control housing 361, and the integral pump assembly 200.

Definitions. As used in this description and the accompanying claims, the following terms shall have the meanings indicated, unless the context otherwise requires:

A "set" includes at least one member.

An "electrical waveform" is a waveform selected from the group consisting of an electrical current waveform, a voltage waveform, and combinations thereof.

The term "user-specifiable input parameter" includes a user-definable attribute pertinent to an alarm setting or calculation for a user interface, such as low flow limit 421*a*, high flow limit 421*b*, and body surface area 421*c* (BSA), as well as combinations of any of the foregoing attributes.

The term "user-specifiable parameter defining the performance of the linear motor" in the course of pumping includes a motor performance attribute such as stroke strength 401*a*, beat rate 401*b*, flow rate, average flow rate, stroke volume, flow index, pulse pressure, output pressure, magnet displacement, as well as combinations of any of the foregoing attributes.

The term "physical flow characteristic" includes a measured attribute such as stroke strength, beat rate, flow rate, average flow rate 411*a*, stroke volume 411*b*, flow index 411*c*, flow rate waveform 412, stroke volume waveform 413, duration over which the pump has been running (e.g., measured by timer 414), as well as combinations of any of the foregoing attributes. If an attribute is user-specified in a given embodiment of the present invention, then measurement of the attribute is of subsidiary importance since its value has been specified. Similarly, if an attribute being measured has primary importance a given embodiment of the present invention, then the parameter would not have been user-specified.

"Normal flow" is flow from the entrance to the inlet port 111 through the chamber 102 to the exit of the outlet port 121.

A "slight reversal of flow" past a ball in a ball check valve is a small, controlled amount of desired reverse flow past the ball before the ball is seated in a closed position.

"Diastole mode" is a phase of operation of a pulsatile pump, according to embodiments of the present invention, during which the diaphragm 202 of the pump-valving assembly 200 is pulled away from the chamber 102 so as to create negative pressure within the chamber 102, inlet ball check valve assembly 110, and third tapered tract 126, but not the fourth tapered tract 122.

"Systole mode" is a phase of operation of a pulsatile pump, according to embodiments of the present invention, during which the diaphragm 202 of the pump-valving assembly 200 is pushed towards the chamber 102, so as to create positive pressure within the chamber 102, outlet ball check valve assembly 120, and the second tapered tract 116, but not the first tapered tract 112.

Figure 4:
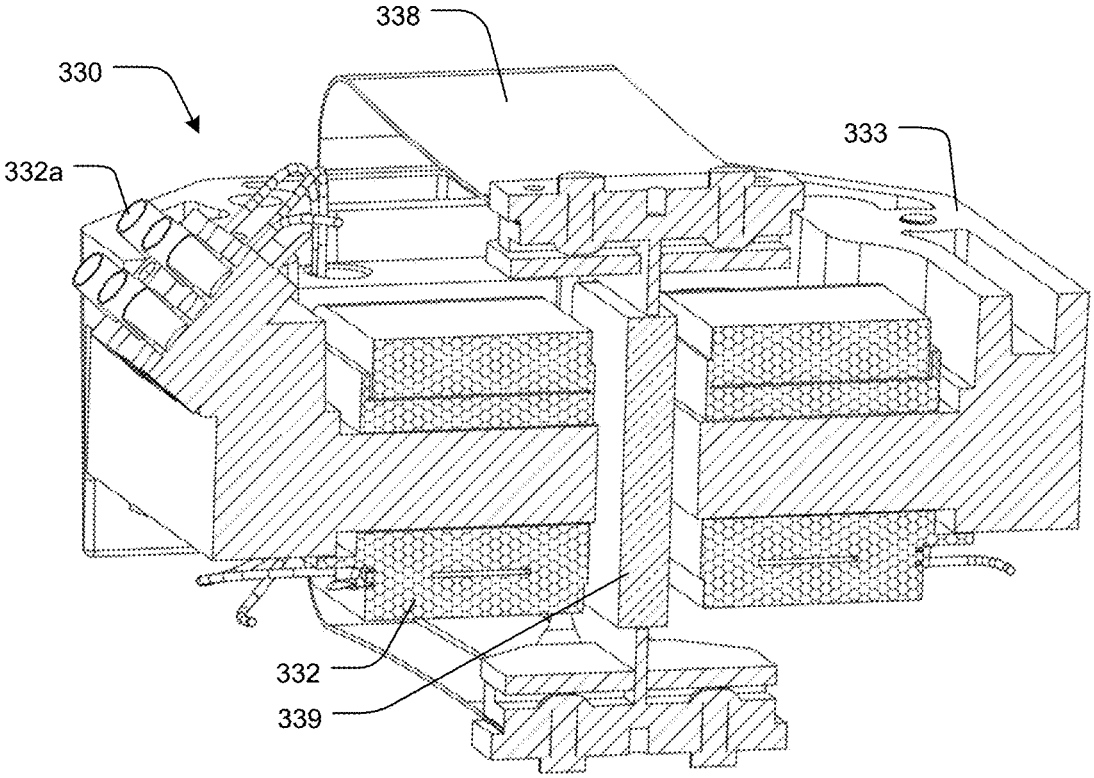
FIG. 4 is a vertical section of the linear motor 330.

FIG. 1 is a vertical section of the pulsatile fluid pump system 301 showing the controller system 311 (with electrical output 311*b*), power amplifier 321 (with electrical input 321*a* and electrical output 321*b*), linear motor 330 (comprised of a stationary member 331 which includes a coil 332 [with electrical input 332*a*], a frame 333, and cooling fins 334, and a moving member which includes a spring 338 of FIG. 4 and a magnet 339), position sensor 371, push rod assembly 341 (comprised of a push rod 342 and force sensor 372), flexible seal 351, control housing 361, and chassis 363. An integral pump assembly 200 (comprised of the pump-valving assembly 101 with chamber 102, diaphragm assembly 201, and peripheral flange 221*a*) is configured to be removably coupled to the control housing 361, and the diaphragm assembly 201 of the integral pump assembly 200 is configured to be removably coupled to the linear motor 330. The integral pump assembly 200 has a flange 221*a* that slides in the channel 362. The integral pump assembly 200 is held in place by the peripheral flange 221*a* and compliant member 221*c* of FIG. 10 in the channel 362 within the control housing 361. (In these figures, like numbered items correspond to similar components across different figures.)

Figure 2:
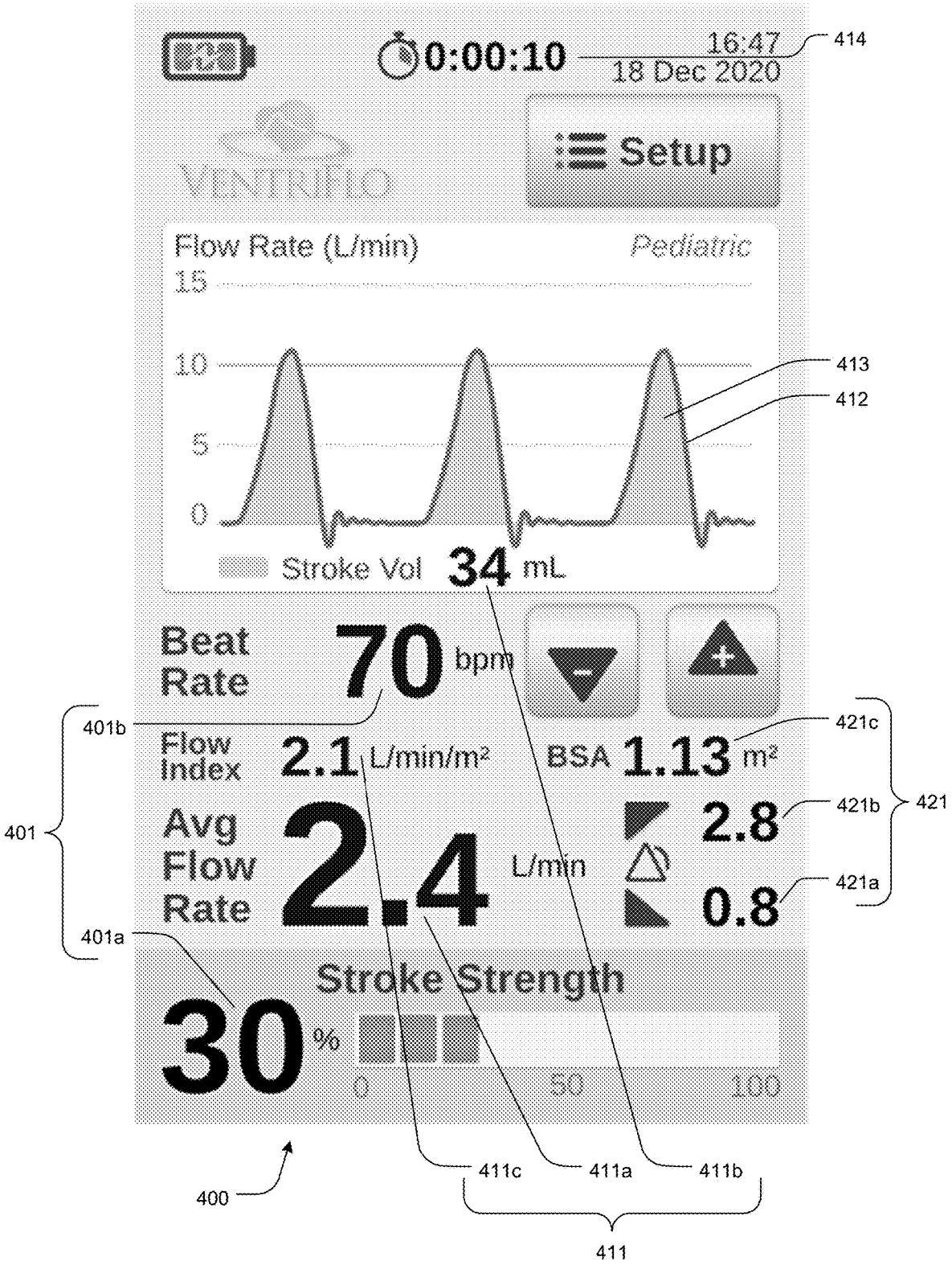
FIG. 2 is an example of the touch-sensitive graphic display 400 user interface showing the user-specifiable motor parameters 401, flow characteristics 411, and user-specifiable input parameters 421.

FIG. 2 is an example of a touch-sensitive graphic display 400 user interface showing user-specifiable motor parameters 401. In this interface appear parameters stroke strength 401*a* and beat rate 401*b*. These parameters are a subset of user-specifiable parameters defining the performance of the linear motor. Additionally, in this interface appear flow characteristics 411 (average flow rate 411*a*, stroke volume 411*b*, flow index 411*c*), flow rate waveform 412, stroke volume waveform 413, and timer 414. These flow-based attributes are a subset of physical flow characteristics. Additionally, the interface displays user-specifiable inputs 421 (low flow limit 421*a*, high flow limit 421*b*, and body surface area 421*c*).

Figure 3:
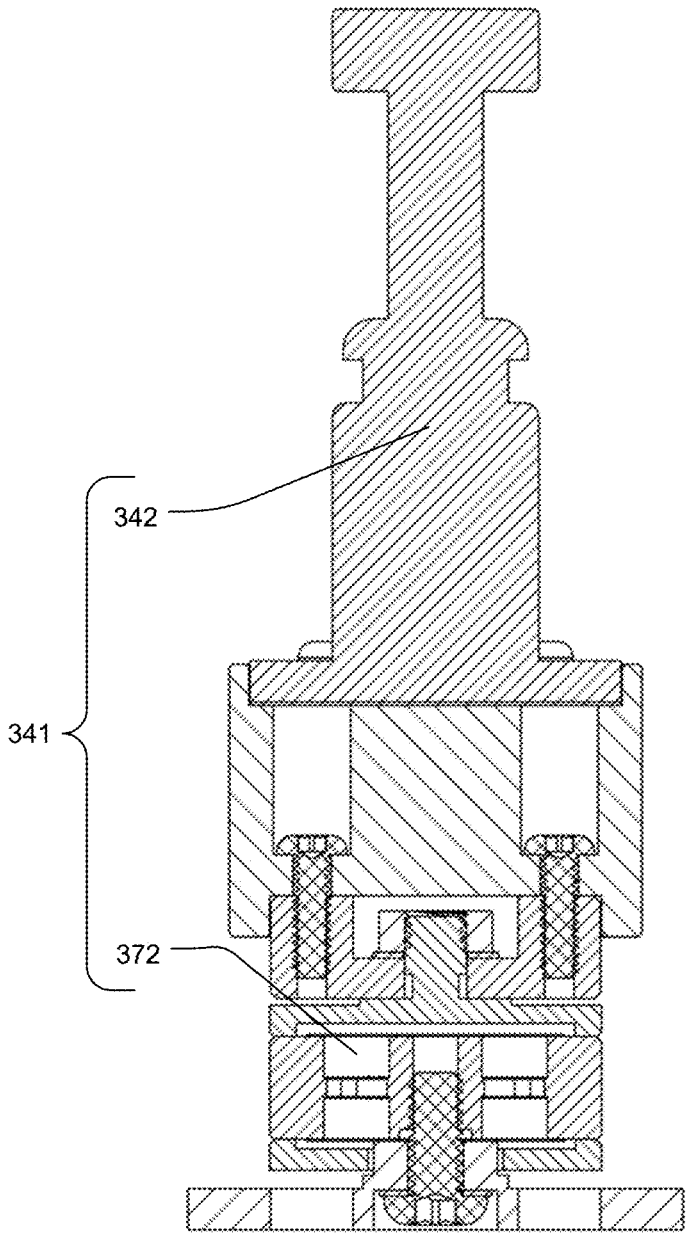
FIG. 3 is a vertical section of the push rod assembly 341.

FIG. 3 is a vertical section of the push rod assembly 341 comprised of the push rod 342 and force sensor 372. The push rod may have a neck with a first radial dimension, disposed on an upper portion of the push rod, and capped by a head having a second radial dimension larger than the first radial dimension.

FIG. 4 is a vertical section of the linear motor 330, showing the coil 332 with electrical input 332*a*, the frame 333, the magnet centering spring 338, and the magnet 339. Other components and detail of the motor are provided in FIG. 1.

Figure 5:
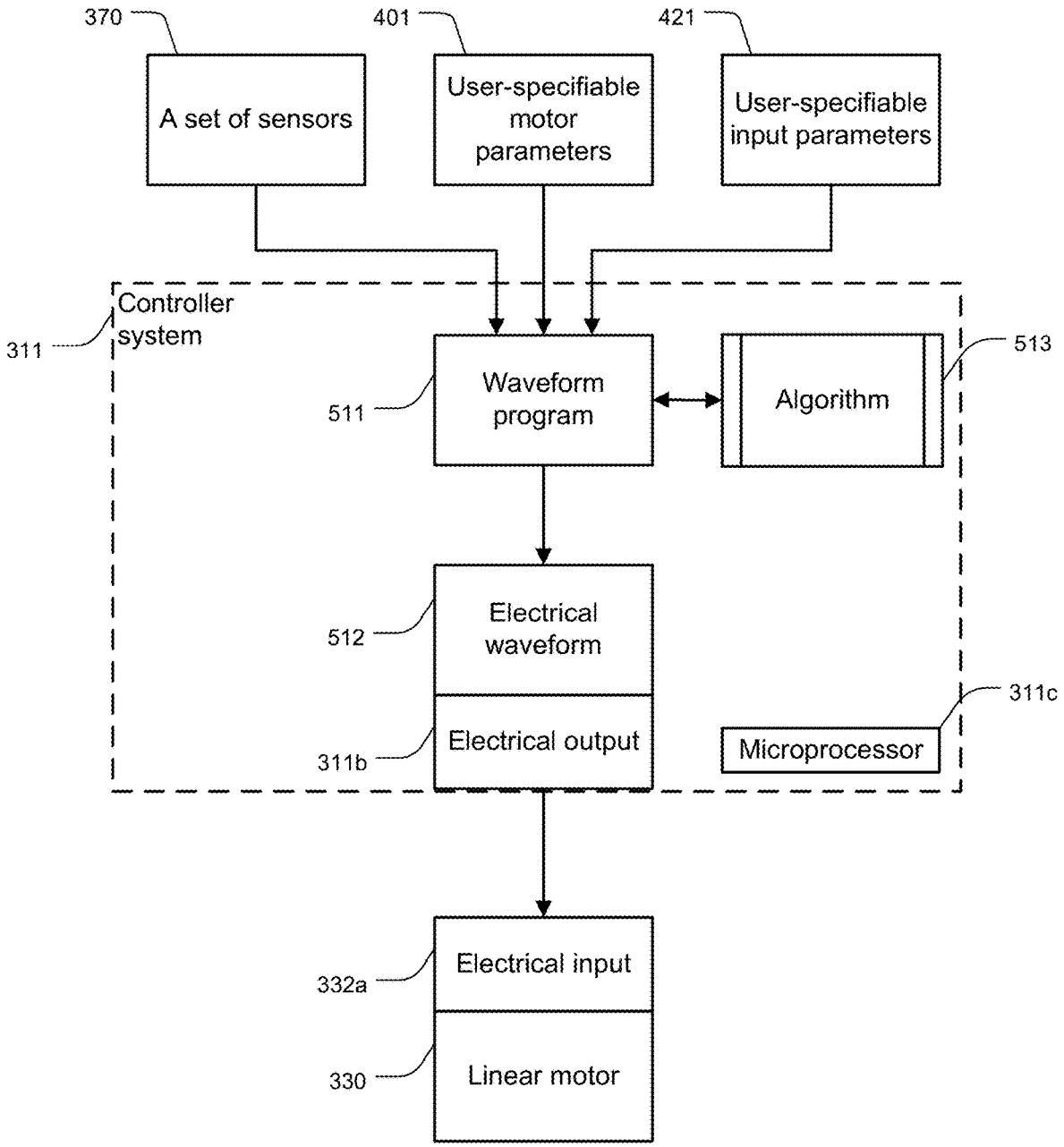
FIG. 5 is a block diagram describing a waveform program 511.

In FIG. 5, the waveform program 511 is a computer program executed by the controller system 311 microprocessor 311*c* which accepts input from a set of sensors 370 (including position sensor 371 of FIG. 1, force sensor 372 of FIGS. 1 and 3, and an external flow sensor 373 of FIG. 8), a set of user-specifiable motor parameters 401 (stroke strength 401*a* and beat rate 401*b*) defining performance of a linear motor 330 in the course of pumping. Additionally, FIG. 5 shows a set of user-specifiable input parameters 421 (low flow limit 421*a*, high flow limit 421*b*, and body surface area 421*c*). The waveform program 511 outputs an electrical waveform 512, the result of a set of algorithms 513, at the electrical output 311*b*. The electrical output 311*b* is coupled to electrical input 332*a* of linear motor 330.

There is growing consensus that desirable characteristics of a pulsatile pump should include both sufficient hemodynamic energy and a human-like waveform architecture. To evaluate pulsatile flow, we choose the human heart as the best model: it delivers a proper stroke volume at a natural cadence with a physiologic rest at the end of each stroke, adapting to the physiologic demands of the patient by adjusting the cardiac output, as the product of stroke volume and beat rate. Via the left ventricle, the human heart provides hemodynamic energy that results in a pressure wave that propagates fully through the elastic arterial tree. It appears that only a biomimetic stroke volume delivered in a biomimetic time frame (like the native systolic contraction produced by the heart) allows the elastic arterial tree to properly relax during the diastolic phase. Use of continuous flow devices stretches the elastic arterial wall but never allows proper relaxation, creating constant and atypical stress on the endothelial cells and interfering with natural baroreceptor sympathetic and parasympathetic signaling, thus disrupting the body's homeostatic control state.

The waveform program 511 causes the pulsatile fluid pump system 301 to replicate the ability of the left ventricle of the human heart to deliver physiological hemodynamic energy proportional to a user-specified stroke strength 401*a* by causing delivery of the necessary fraction of the stroke volume of a pump chamber 102 in a physiologic natural cadence at a user-specified beat rate 401*b*. It is a user (a perfusionist) of the pulsatile fluid pump system 301 who adjusts the stroke strength 401*a* (an indirect specification of stroke volume) and beat rate 401*b* to meet the physiologic demand of the patient. Furthermore, the waveform program 511 replicates the physiologic rest at the end of each stroke, thereby allowing natural relaxation of the arterial tree.

The structure of a pulsatile pump in accordance with various embodiments of the present invention can usefully reflect attributes of the human heart. The human heart is preload sensitive—the heart cannot "pull" blood into the left ventricle; it can only allow the blood available to flow naturally into the ventricle. The human heart is also afterload sensitive in that it is responsive to the compliance and resistance in the downstream vasculature and doesn't exert excess force on the blood, which could damage the vasculature. Lastly, the left ventricle cannot deliver blood that isn't in the ventricle when it contracts; there is a limited bolus of blood that it can deliver.

Similarly, the pulsatile fluid pump system 301 has similar attributes of inherent safety: it is preload and afterload sensitive, and it is limited in both the volume of blood it can deliver and the force at which it can deliver that bolus of blood. When filling, the pulsatile fluid pump system 301 allows gravity filling from the venous reservoir, exerting minimal negative pressure. When emptying, the linear motor 330 is inherently limited in the force that it can generate by its design. As such, it cannot overpressure the downstream tubing or vasculature, instead delivering less than the volume of blood in the pump chamber 102, thereby only delivering as much volume as the vasculature can receive.

The integral pump assembly 200 is analogous to a left ventricle of the human heart; the inlet ball check valve assembly 110 used in various embodiments hereof is analogous to a mitral valve; and the outlet ball check valve assembly 120 used in various embodiments hereto is analogous to an aortic valve. Like the human heart, the inlet 110 and outlet 120 ball check valve assemblies are passive and require a slight reversal of flow to close. This slight reversal of flow mimics the slight reversal that occurs when the aortic valve of the human heart closes.

Figure 6:
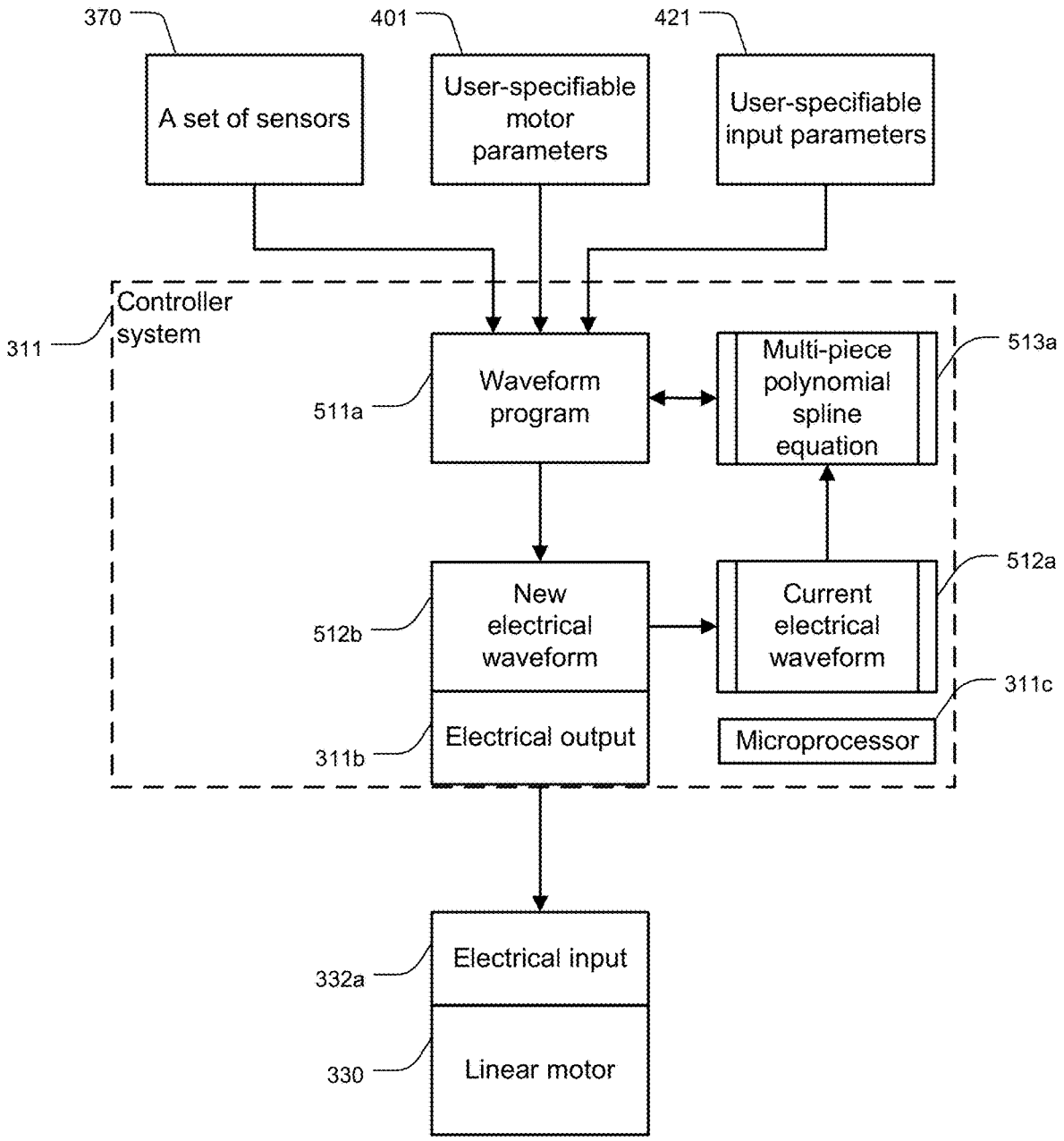
FIG. 6 is a block diagram describing a first embodiment 511*a* of the waveform program 511.

In one embodiment, of the present invention, show in FIG. 6, a waveform program 511*a* is a computer program executed by the controller system 311 microprocessor 311*c* which accepts input from a set of sensors 370, a set of user-specifiable motor parameters 401, and a set of user-specifiable input parameters 421. The waveform program 511*a* is configured to simulate a waveform that has been experimentally determined to be appropriate for embodiments of the pulsatile fluid pump system 301 of the present invention. The waveform program 511*a* simulates the experimentally determined waveform by repeatedly performing a multi-piece polynomial spline algorithm 513*a* and the resulting waveform is used to drive the linear motor 330. In the event that the user changes one of the user-specifiable motor parameters 401, the waveform program 511*a* uses zero or more of the current and/or previous values from the set of sensors 370, along with the set of user-specifiable motor parameters 401, zero or more flow characteristics 411, zero or more user-specifiable input parameters 421, and the current electrical waveform 512*a* to create a new electrical waveform 512*b*. The waveform program 511*a* outputs the new electrical waveform 512*b*, consisting of discrete output voltages at defined time durations, at the electrical output 311*b*. The electrical output 311*b* is coupled to electrical input 332*a* of linear motor 330.

Figure 7:
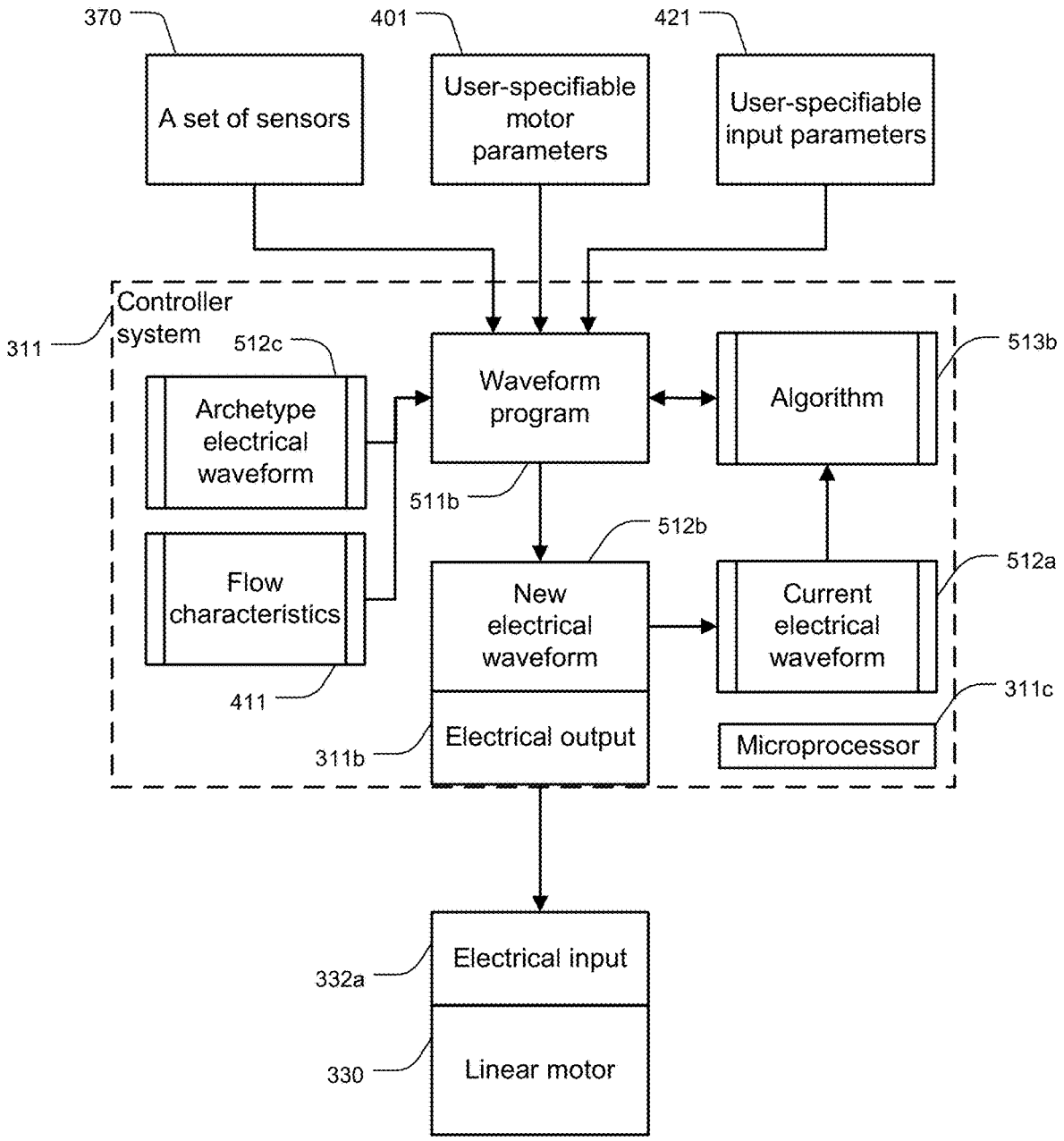
FIG. 7 is a block diagram describing a second embodiment 511*b* of the waveform program 511.

In another embodiment of the present invention, shown in FIG. 7, the waveform program 511*b* is a computer program executed by the controller system 311 microprocessor 311*c* which accepts input from a set of sensors 370, a set of user-specifiable motor parameters 401, and a set of user-specifiable input parameters 421. The waveform program 511*b* reads a prototype electrical waveform 512*c* stored electronically within the controller system 311. The waveform program 511*b* then uses an algorithm 513*b* to adjust the archetype electrical waveform 512*c*. The algorithm 513*b* creates a new waveform 512*b* from the archetype electrical waveform 512*c* using zero or more of the current and/or previous values of the set of sensors 370, along with the set of user-specifiable motor parameters 401, zero or more flow characteristics 411, zero or more user-specifiable input parameters 421, and the current electrical waveform 512*a*. The waveform program 511*b* outputs the new electrical waveform 512*b*, consisting of discrete output voltages at defined time durations, at the electrical output 311*b*. The electrical output 311*b* is coupled to electrical input 332*a* of linear motor 330.

Figure 8:
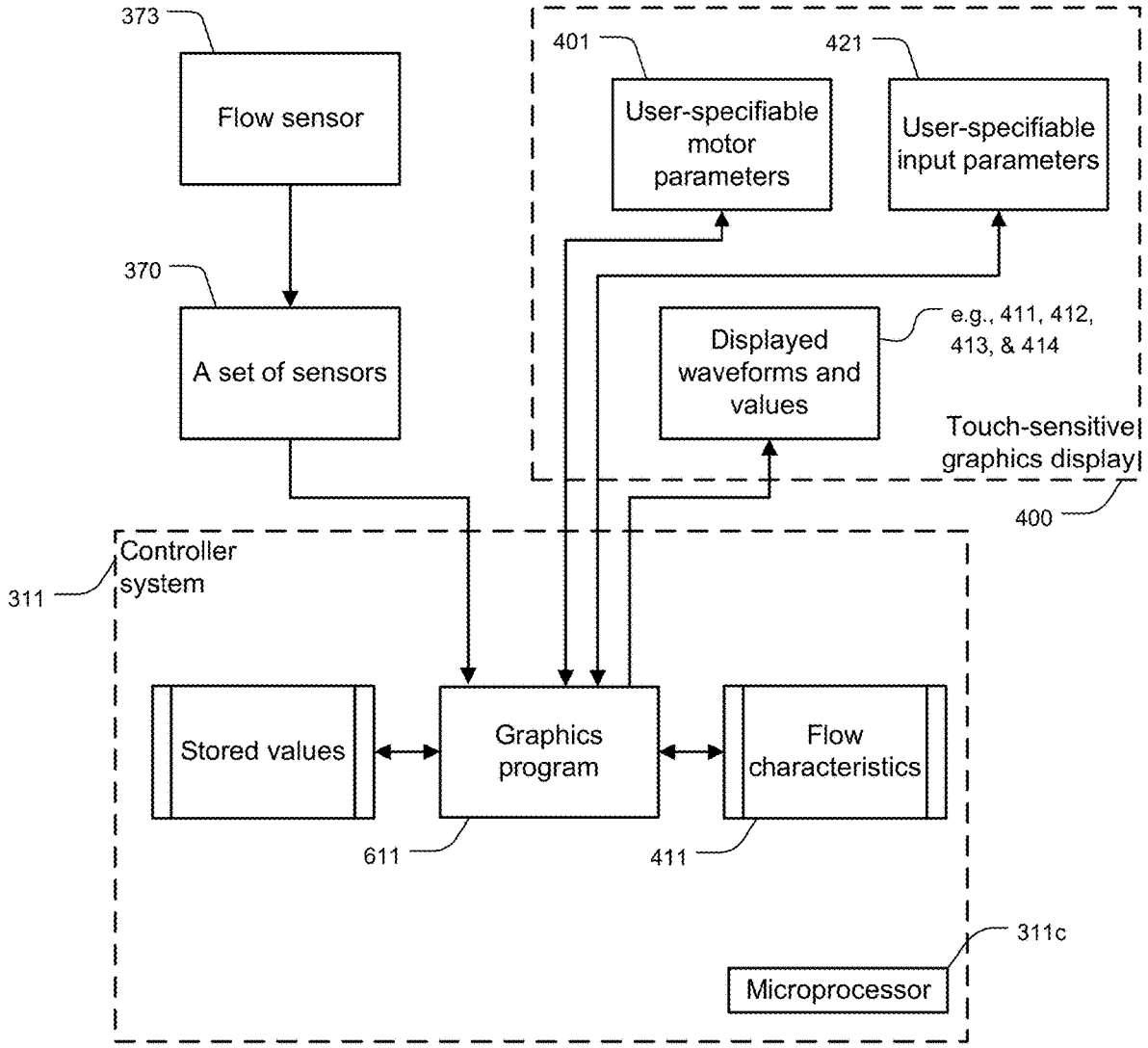
FIG. 8 is a block diagram describing a graphics program 611.

In FIG. 8, the graphics program 611 is a computer program executed by the controller system 311, which accepts user-specifiable motor parameters 401 and user-specifiable input parameters 421. The graphics program 611 causes a set of current values of the user-specifiable motor parameters 401, a set of flow characteristics 411, and a set of user-specifiable input parameters 421 to be shown on the graphic display 400.

The operation of the waveform programs 511, graphics program 611, and graphic display 400 is discussed in further detail in the related patent, referenced above, bearing patent number 11,300,119.

Figure 9:
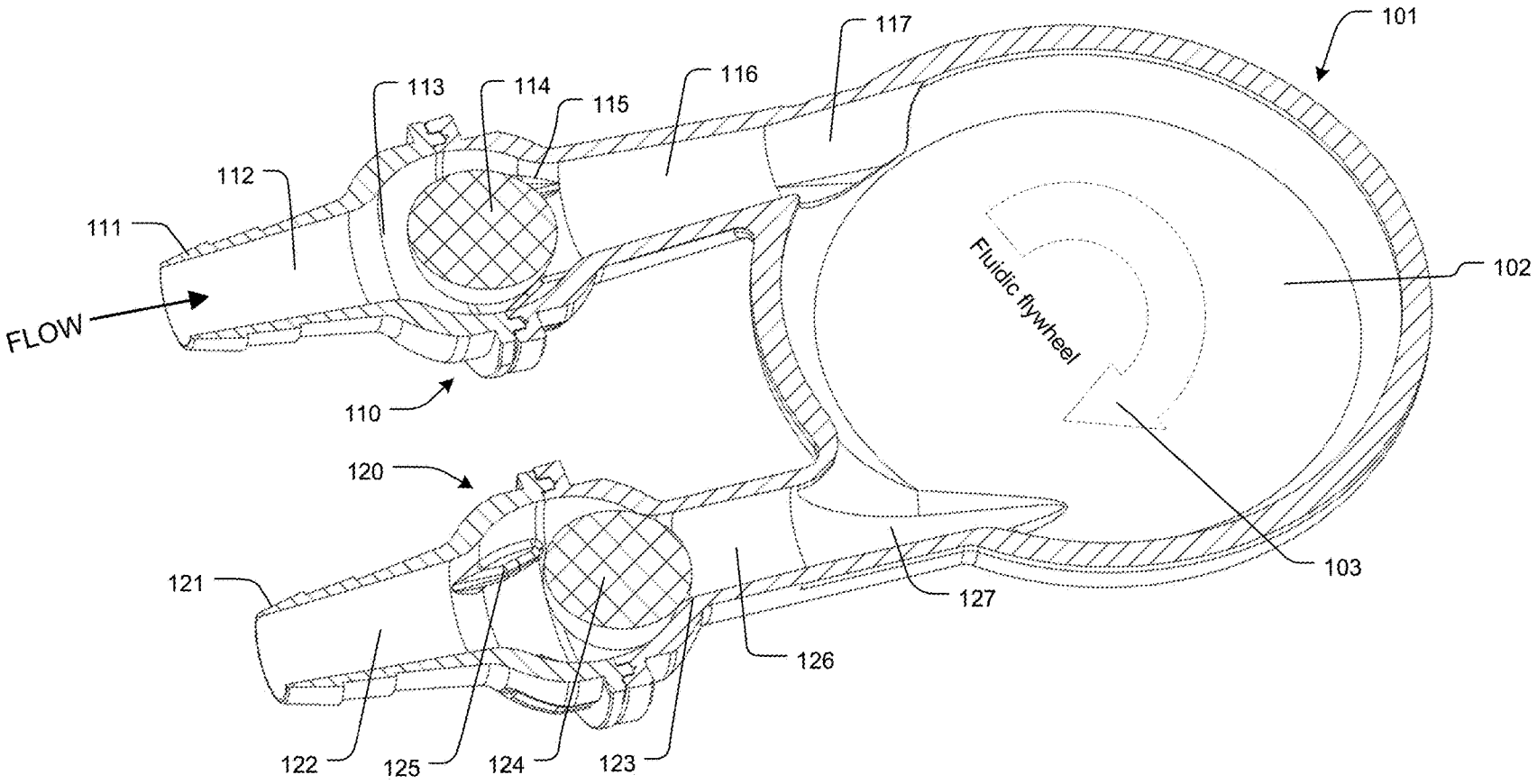
FIG. 9 is a horizontal section of a pump-valving assembly 101 in accordance with an embodiment of the present invention, wherein the pump-valving assembly 101 is in diastole mode in which the chamber 102 is being filled.

FIG. 9 is a horizontal section of a pump-valving assembly 101 in accordance with an embodiment of the present invention, wherein the pump-valving assembly 101 is in diastole mode in which the chamber 102 is being filled. Fluid flows into the inlet port 111, through the first tapered tract 112, past the inlet ball 114, as that inlet ball 114 engages against the inlet ribs 115 that create gaps between the inlet ball 114 and the second tapered tract 116 that allow fluid to flow into the second tapered tract 116 and then into the chamber 102. The pump-valving assembly 101 operates in cooperation with an edge mount 202*a* diaphragm 202 that seats around the circumference of the chamber 102. The motion of the diaphragm in cooperation with the inlet ball check valve assembly 110 and the outlet ball check valve assembly 120 causes the flow of fluid into the chamber 102. While the chamber 102 is filling, the outlet ball 124 in the outlet ball check valve assembly 120 settles against the outlet seat 123 to prevent fluid flow from the outlet port 121 back into the chamber 102. The fluidic flywheel 103 is illustrated. The pump-valving assembly 101 is discussed in further detail in the related application, referenced above, bearing publication number 2022/0265994.

Figure 10:
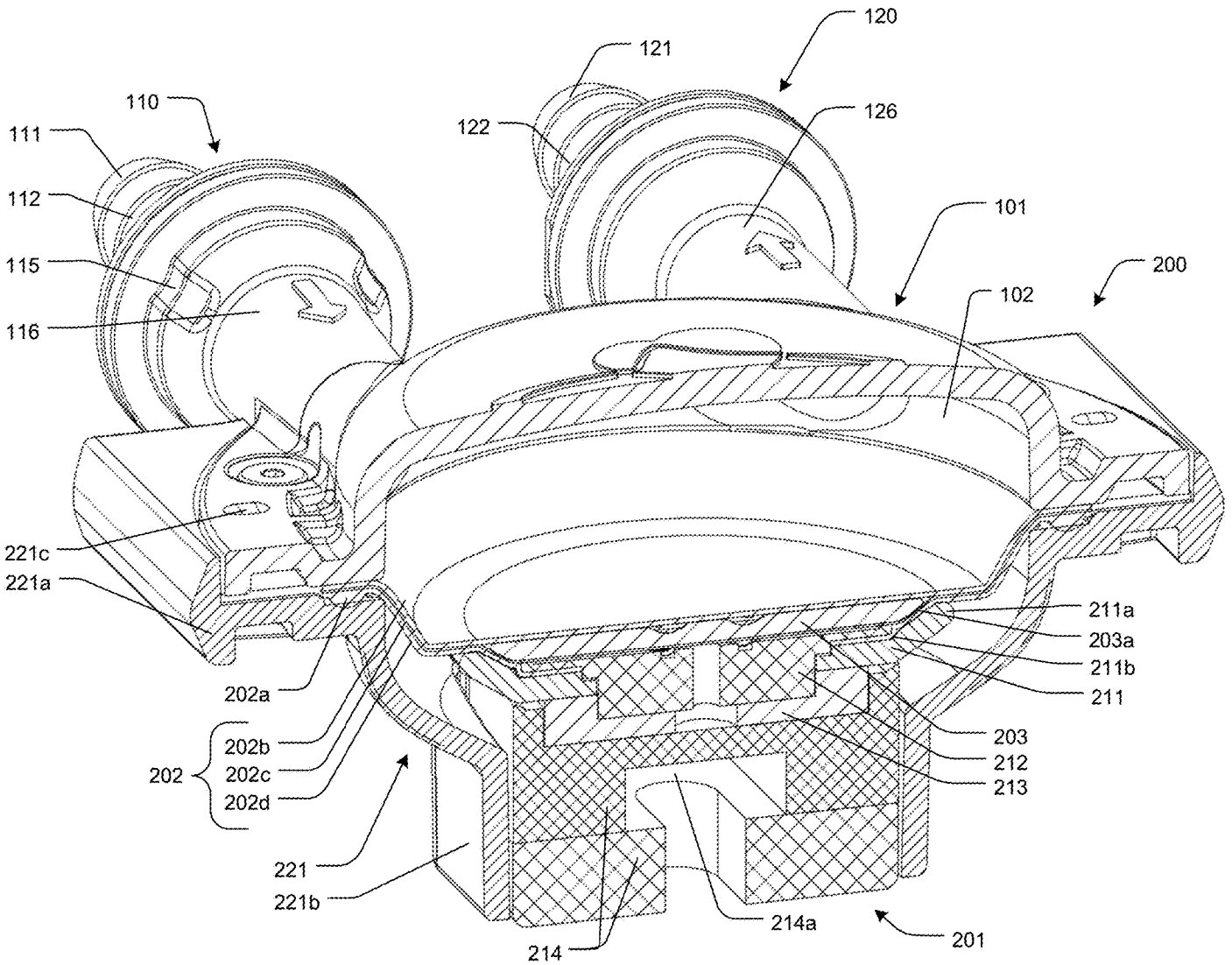
FIG. 10 is a vertical section of an integral pump assembly 200 showing a diaphragm assembly 201 mounted to a pump-valving assembly 101 in diastole mode, in which the chamber 102 is being filled.

FIG. 10 is a vertical section of an integral pump assembly 200 showing a diaphragm assembly 201 mounted to a pump-valving assembly 101 in diastole mode, in which the chamber 102 is being filled. The edge mount 202*a* diaphragm 202 of the diaphragm assembly 201 is flexible and mounted at the edge of the chamber 102 of the pump valving assembly 101. The diaphragm 202 has an inside surface 202*b* for contacting a fluid in the chamber 102 to be pumped and an outside surface 202*d* exposed to ambient air. The integral pump assembly 200 includes a pump housing 221 including a neck 221*b* in which the coupler 214 reciprocates as the diaphragm 202 reciprocates. The coupler 214 contains a receptacle 214*a* that is sized to receive the head and a least part of the neck of push rod 342 as shown in FIG. 1. The neck 221*b* is configured to maintain axial alignment of the coupler 214 and (via physical features, such as flattened sides) is also configured to maintain rotational alignment of the coupler 214. The pump-valving assembly 101 is discussed in further detail in the related application, referenced above, bearing publication number 2022/065994. As the diaphragm 202 is pulled down, in a diastole mode (in a direction away from the chamber 102), to cause filling of the chamber 102, it creates a negative pressure that draws fluid into the chamber 102 through the inlet port 111. Similarly, as the diaphragm 202 is pushed up, in a systole mode (in a direction into the chamber 102), it creates a positive pressure that causes flow of the fluid out of the chamber 102 through the outlet port 121. The integral pump assembly 200 is discussed in further detail in the related patent, referenced above, bearing patent number 11,236,741.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A pulsatile fluid pump system comprising:

a pump-valving assembly including a chamber and a set of ports;

a diaphragm assembly coupled to the chamber and including an edge-mounted flexible diaphragm having an inside surface for contacting a fluid in the chamber to be pumped and an outside surface exposed to ambient air, and a coupler configured to reciprocate with the diaphragm;

wherein the diaphragm assembly and the pump-valving assembly are configured as an integral pump assembly, including a pump housing having a pump housing neck configured to maintain axial and rotational alignment of the coupler via flattened sides;

a control housing for removably and slidably receiving and being removably coupled to the integral pump assembly, the control housing including:

a linear motor having a magnet and a coil, the magnet reciprocating in an axial direction in relation to the coil, the coil having an electrical input;

a push rod, coupled to the linear motor, having a neck with a first radial dimension, disposed on an upper portion of the push rod, and capped by a head having a second radial dimension larger than the first radial dimension, the push rod reciprocating axially, and configured for slidable attachment to the diaphragm assembly; and a controller system having an electrical output coupled to the electrical input of the coil, the controller system defining an electrical waveform at the electrical output to cause a desired operation of the diaphragm, wherein the diaphragm assembly includes a slot configured to slidably receive the head and at least portion of the neck of the push rod.

2. A pulsatile fluid pump system according to claim 1, further comprising a force sensor coupled between the linear motor and the push rod.

3. A pulsatile fluid pump system according to claim 1, further comprising a flexible seal surrounding the push rod.

4. A pulsatile fluid pump system according to claim 1, further comprising a set of cooling fins thermally coupled to the coil of the linear motor.

5. A pulsatile fluid pump system according to claim 1, wherein the controller system includes a microprocessor, and the controller system is configured to execute a waveform program defining the electrical waveform at the electrical output to cause the desired operation of the diaphragm.

6. A pulsatile fluid pump system according to claim 1, wherein the integral pump assembly has a peripheral flange, and the control housing has a channel configured to removably receive the peripheral flange when the diaphragm assembly of the integral pump assembly is removably coupled to the linear motor.

7. A pulsatile fluid pump system according to claim 6, wherein at least one of the peripheral flange and the channel has a set of compliant members to physically bias the peripheral flange in the control housing.

8. A pulsatile fluid pump system according to claim 7, wherein each compliant member includes a spring.

9. A pulsatile fluid pump system according to claim 8, wherein the set of compliant members is included in a set of ball detents.

10. A pulsatile fluid pump system according to claim 1, further comprising a set of compliant members configured to removably secure the integral pump assembly to the control housing.

11. An integral pump assembly for a pulsatile fluid pump system, the integral pump assembly comprising:

a pump-valving assembly including a chamber and a set of ports; and a diaphragm assembly coupled to the chamber and including an edge-mount flexible diaphragm having an inside surface for contacting a fluid in the chamber to be pumped and an outside surface exposed to ambient air, and a coupler configured to reciprocate with the diaphragm;

wherein the pump-valving assembly and diaphragm assembly are disposed in an integral pump assembly housing, having a pump housing neck configured to maintain axial and rotational alignment of the coupler via flattened sides, and configured to be removably coupled to a control housing for removably and slidably receiving and being removably coupled to the integral pump assembly, the control housing including a linear motor having a magnet and a coil, the magnet reciprocating in an axial direction in relation to the coil, the control housing further including a push rod having a neck with a first radial dimension, disposed on an upper portion of the push rod, and capped by a head having a second radial dimension larger than the first radial dimension, the push rod coupled to the linear motor, and also reciprocating axially, and configured for slidable attachment to the diaphragm assembly, the coil having an electrical input, wherein the electrical input of the coil is coupled to an electrical output of a controller system defining an electrical waveform at the electrical output to cause a desired operation of the diaphragm and wherein the diaphragm assembly includes a slot configured to slidably receive the head and at least a portion of the neck of the push rod.

12. An integral pump assembly according to claim 11, further comprising a set of compliant members configured to removably secure the integral pump assembly housing to the control housing.

13. An integral pump assembly for a pulsatile fluid pump system according to claim 11, wherein the integral pump assembly housing includes a peripheral flange, and the control housing has a channel configured to removably receive the peripheral flange when the diaphragm assembly of the integral pump assembly is removably coupled to the linear motor.

14. An integral pump assembly for a pulsatile fluid pump system according to claim 13, wherein the peripheral flange has a set of compliant members to physically bias the peripheral flange in the control housing.

15. An integral pump assembly for a pulsatile fluid pump system according to claim 14, wherein each compliant member includes a spring.

16. An integral pump assembly for a pulsatile fluid pump system according to claim 14, wherein the set of compliant members is included in a set of ball detents.

17. A control housing for removably and slidably receiving and being removably coupled to an integral pump assembly for a pulsatile fluid pump system, wherein the integral pump assembly includes (i) a pump-valving assembly including a chamber and a set of ports, (ii) a diaphragm assembly coupled to the chamber and including an edge-mount flexible diaphragm having an inside surface for contacting a fluid in the chamber to be pumped and an outside surface exposed to ambient air and a coupler configured to reciprocate with the diaphragm; and wherein the pump-valving assembly and diaphragm assembly are disposed in an integral pump assembly housing having a pump housing neck configured to maintain axial and rotational alignment of the coupler via flattened sides, the control housing comprising:

a chassis;

a linear motor, rigidly coupled to the chassis, and having a magnet and a coil, the magnet reciprocating in an axial direction in relation to the coil, the coil having an electrical input;

a push rod, coupled to the linear motor, having a neck with a first radial dimension, disposed on an upper portion of the push rod, and capped by a head having a second radial dimension larger than the first radial dimension, the push rod reciprocating axially, and configured for slidable attachment to the diaphragm assembly; and a controller system having an electrical output coupled to the electrical input of the coil, the controller system defining an electrical waveform at the electrical output to cause a desired operation of the diaphragm, wherein the diaphragm assembly includes a slot configured to slidably receive the head and at least a portion of the neck of the push rod.

18. A control housing according to claim 17, wherein the integral pump assembly has a peripheral flange, the control housing further comprising a channel configured to removably receive the peripheral flange when the diaphragm assembly of the integral pump assembly is removably coupled to the linear motor.

* * * * *